US006643934B2

(12) United States Patent
Pope

(10) Patent No.: US 6,643,934 B2
(45) Date of Patent: Nov. 11, 2003

(54) SELF-SHARPENING POCKET KNIFE

(76) Inventor: Major Harold Pope, P.O. Box 17744, Pensacola, FL (US) 32522

( * ) Notice: Subject to any disclaimer, the term of this patent is extended or adjusted under 35 U.S.C. 154(b) by 0 days.

(21) Appl. No.: 09/967,231

(22) Filed: Oct. 1, 2001

(65) Prior Publication Data

US 2003/0061714 A1 Apr. 3, 2003

(51) Int. Cl.[7] ..... B25F 3/00
(52) U.S. Cl. ..... 30/138; 30/161
(58) Field of Search ..... 30/138, 139, 298.4, 30/36, 161; 83/174; 7/118–120; 76/82; 451/555

(56) References Cited

U.S. PATENT DOCUMENTS 4,718,200 A * 1/1988 Miquelot ..... 30/138 X

FOREIGN PATENT DOCUMENTS

GB 11121 * 5/1914 ..... 30/138

* cited by examiner

*Primary Examiner*—Douglas D. Watts
(74) *Attorney, Agent, or Firm*—George A. Bode; Robert T. Vorhoff; Bode & Associates

(57) ABSTRACT

A self-sharpening pocket knife is provided that includes a housing having abrasive stone strips or other sharpening means, and additional means for biasing the strips inward so that as the stone wears down there is always enough surface area in contact with the blade to sharpen it. The biasing means may take the form of foam rubber which expands, or multiple coiled springs, with either means being positioned between the walls of the housing and the stone strips.

15 Claims, 2 Drawing Sheets

SELF-SHARPENING POCKET KNIFE

BACKGROUND OF THE INVENTION

1. Field of the Invention

The present invention relates to improved sharpening means for pocket and other knives. More particularly, the present invention provides an efficient, effective and easily used sharpening means which is integral to the structure of a knife.

2. General Background

Sharpening means for knives are known in various shapes, forms and materials, however most such means are separate devices from the knife itself and require some degree of expertise to be properly used. To overcome these drawbacks, knives with sharpening means incorporated into the knife or sheath have been developed and are known in the art. An additional problem associated with these type devices is that as the sharpening means becomes worn, there may not be enough surface area in contact with the blade edge to properly sharpen it. It is believed that the self-sharpening pocket knife of the present invention solves this problem.

Several devices have been patented which are aimed at incorporating a sharpening means into a knife or sheath.

U.S. Pat. No. 2,791,831, by Hollis, discloses a folding jackknife or pocket knife having abrasive strips lining opposite sides of the blade housing or chamber, so that the blade is sharpened when it is moved into contact with the strips when folding the blade for storage.

U.S. Pat. No. 2,416,929, by Kjorsvik, discloses a folding pocket knife with abrasive sharpening disks positioned inside the blade casing or housing so that the blade edge is sharpened when it is moved into contact with the disks when folding the blade for storage.

U.S. Pat. No. 4,501,068, by Palson, issued to The Phillips Manufacturing Company, of Canton, Mass., discloses a folding pocket knife having a cutting blade and sharpening blade, both sheathed within a chamber of the handle.

U.S. Pat. No. 1,170,433, by Ellebrecht, discloses a folding razor that is self-lubricating and comprises absorbent strips lining opposite sides of the blade housing so that the blade is lubricated when it is moved into contact with the strips when folded for storage.

U.S. Pat. No. 4,974,322, by Butka, discloses a knife with a blade or cutting member attached to a handle, with the blade being sharpened by inserting and rubbing it in its casing or sheath that is made of material more abrasive and stronger than the blade.

U.S. Pat. No. 1,208,435, by Young, discloses a folding knife with a sharpening whet stone mounted to the outer surface of the blade housing or frame.

U.S. Pat. Nos. 1,270,727 and 5,649,129 are also representative of the state of the art.

The above patents present in the art are directed to different devices for providing sharpening means as an integral part of a knife or sheath, but none of them address the problem of keeping the sharpening means in contact with the blade once the sharpening means becomes worn.

SUMMARY OF THE PRESENT INVENTION

The preferred embodiment of the present invention solves the aforementioned problem in a straightforward and simple manner. What is provided is a self-sharpening pocket knife including a housing having abrasive stone strips or other sharpening means, and additional means for biasing the strips inward so that as the stone wears down there is always enough surface area in contact with the blade to sharpen it. The biasing means may take the form of foam rubber which expands, or multiple coiled springs, either means being positioned between the walls of the housing and the stone strips.

An additional embodiment of the present invention provides a housing or sheath for a straight knife incorporating the same sharpening and biasing means.

In view of the above, it is an object of the present invention to provide a self-sharpening pocket knife which maintains sufficient surface area with the blade to sharpen it as the sharpening means wears down.

It is an additional object of the present invention to provide a knife housing or sheath with integrated sharpening means that maintains sufficient surface area in contact with the blade to sharpen it as the sharpening means wears down.

The above objects of the present invention will become apparent from the drawing, the description given herein, and the appended claims.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
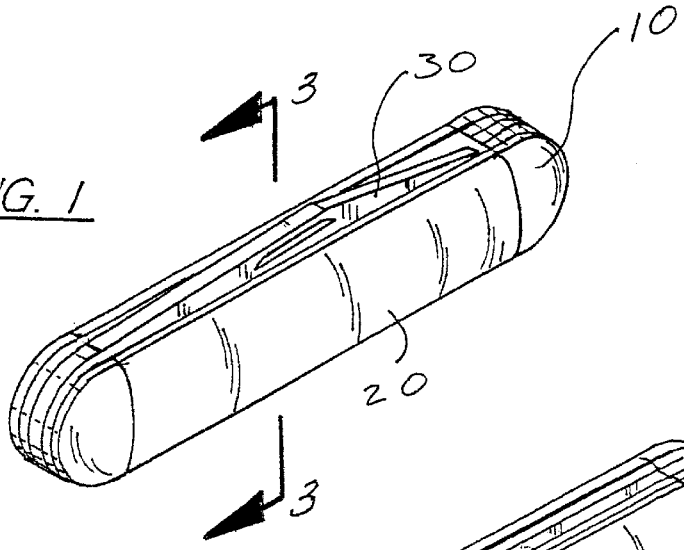
FIG. 1 is a perspective view of the self-sharpening pocket knife of the present invention, with the blade in the closed position.
Figure 2:
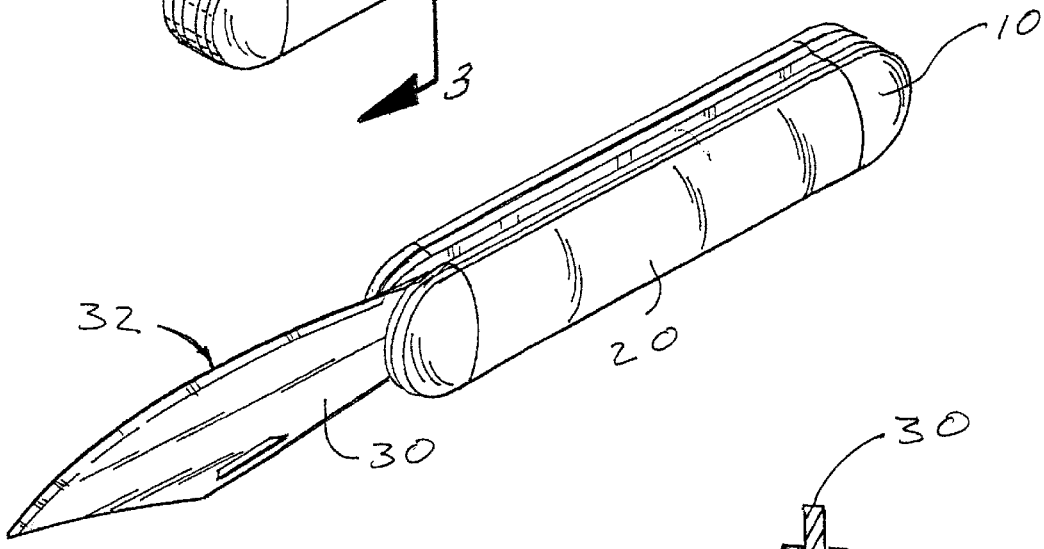
FIG. 2 is a perspective view of the self-sharpening pocket knife of the present invention, with the blade in the open position.

Referring now to the drawing, and in particular FIGS. 1 and 2, the self-sharpening pocket knife of the present invention is designated generally by the numeral 10. Self-sharpening pocket knife 10 is comprised of housing 20 and a pivotally attached folding blade 30.

Figure 3:
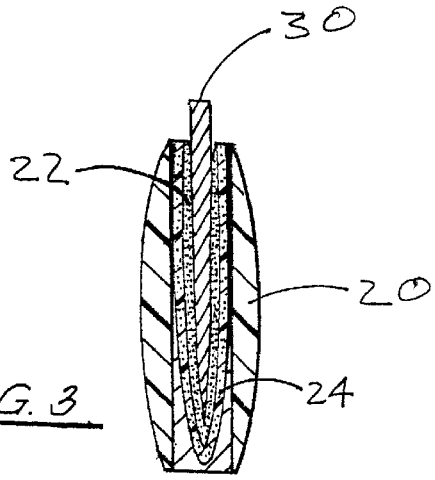
FIG. 3 is a sectional view of the self-sharpening pocket knife of the present invention, taken along LINE 3—3.

Referring now to FIG. 3, housing 20 is further comprised of a sharpening means 22 and a biasing means 24. Sharpening means 22 is attached to the inside of housing 20 and positioned so that as blade 30 is opened and closed, cutting edge 32 of blade 30 comes into contact with sharpening means 22, thereby sharpening cutting edge 32. Biasing means 24 are fixedly attached to and positioned between the interior walls of housing 20 and sharpening means 22 so as to provide an inward force on sharpening means 22. As sharpening means 22 becomes worn, the inward pressure of biasing means 24 ensures that there is enough surface area in contact with blade 30 to sharpen edge 32. In the preferred embodiment, sharpening means 22 is comprised of a stone lining of a roughness equivalent to at least 400 grit sandpaper, and biasing means 24 is comprised of expandable foam rubber.

Figure 4:
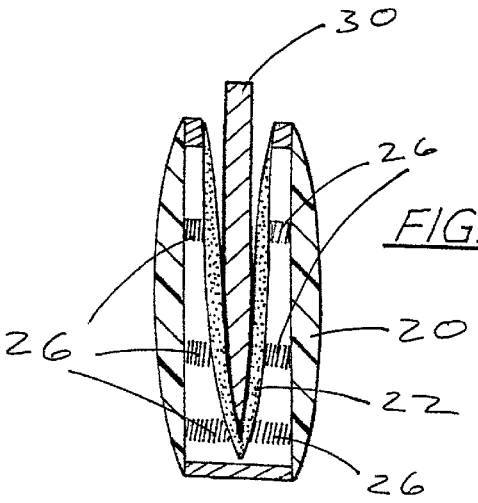
FIG. 4 is a sectional view of an alternate embodiment of the self-sharpening pocket knife of the present invention, taken along LINE 3—3, but showing a different biasing means.

FIG. 4 illustrates an alternate embodiment of the self-sharpening pocket knife of the present invention wherein the biasing means is comprised of springs 26.

Figure 5:
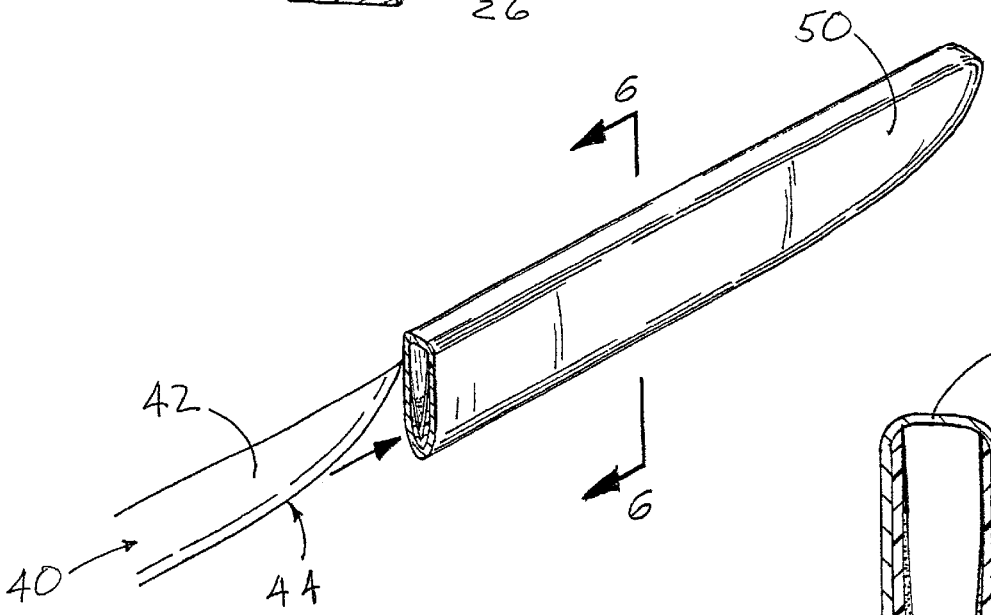
FIG. 5 is a perspective view of an additional alternate embodiment of the present invention, with the sharpening means integrated into a knife sheath.
Figure 6:
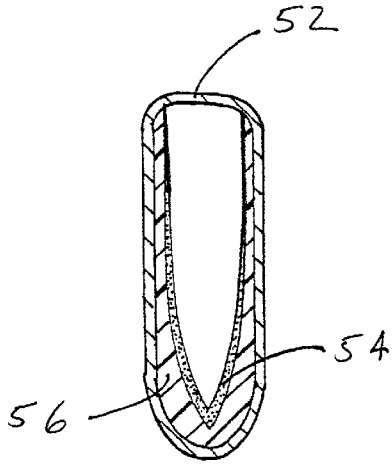
FIG. 6 is a sectional view of an additional alternate embodiment of the present invention, taken along LINE 6—6.

Referring now to FIGS. 5 and 6, a further embodiment of the present invention is comprised of a straight knife 40 having blade 42 with edge 44. Blade 42 is inserted into sheath 50, which is comprised of housing 52, sharpening means 54, and biasing means 56. As in the preferred embodiment, sharpening means 54 is attached to the inside of housing 52 and positioned so that edge 44 comes in contact with sharpening means 54 when blade 42 is inserted into sheath 50. As in the previous embodiments, biasing means 56 can take the form of either expandable foam rubber or springs, and is fixedly attached to and positioned between the interior walls of housing 52 and sharpening means 54, so that as sharpening means 54 becomes worn, the inward pressure of biasing means 56 ensures that there is enough surface area of sharpening means 54 in contact with edge 44 to sharpen Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A self-sharpening folding pocket knife comprising: a blade having a cutting edge, said blade being pivotally attached to a sharpening housing therefor, said housing further comprising: a sharpening means and a means for biasing said sharpening means into contact with said knife, said sharpening means being attached to and positioned in said housing such that as said blade is folded into said housing, said cutting edge comes into contact with said sharpening means, said biasing means being attached to and positioned between said sharpening means and the interior walls of said housing, such that said biasing means provides an inward pressure on said sharpening means to maintain the necessary contact surface area to thereby sharpen said edge.

2. The folding knife of claim 1, wherein said sharpening means is a stone of a roughness equivalent to at least 400 grit sandpaper.

3. The folding knife of claim 1, wherein said biasing means is expandable foam rubber.

4. The folding knife of claim 1, wherein said biasing means are springs.

5. The folding knife of claim 2, wherein said biasing means is expandable foam rubber.

6. The folding knife of claim 2, wherein said biasing means are springs.

7. A self-sharpening knife sheath, comprising a housing capable of accepting a straight knife having a blade with a cutting edge, wherein said housing further comprises: a sharpening means for said knife and means for biasing said sharpening means into contact with said knife, said sharpening means being attached to and positioned in said housing such that as said blade of said knife is inserted into said housing, said cutting edge comes into contact with said sharpening means, said biasing means being attached to and positioned between said sharpening means and the interior walls of said housing, such that said biasing means provides an inward pressure on said sharpening means to maintain the necessary contact surface area to thereby sharpen said knife, said sharpening means being a stone of a roughness equivalent to at least 400 grit sandpaper.

8. The knife sheath of claim 7, wherein said biasing means is expandable foam rubber.

9. The knife sheath of claim 7, wherein said biasing means are springs.

10. The knife sheath of claim 7, wherein said biasing means is expandable foam rubber.

11. The knife sheath of claim 7, wherein said biasing means are springs.

12. The folding knife of claim 4, wherein said biasing means are a plurality of spaced-apart coiled springs.

13. The folding knife of claim 12, wherein said plurality of spaced-apart coiled springs are positioned vertically of said interior walls of said housing.

14. The folding knife of claim 9, wherein said biasing means are a plurality of spaced-apart coiled springs.

15. The folding knife of claim 14, wherein said plurality of spaced-apart coiled springs are positioned vertically of said interior walls of said housing.

* * * * *